US011513470B2

(12) United States Patent
Suzuki et al.

(10) Patent No.: US 11,513,470 B2
(45) Date of Patent: Nov. 29, 2022

(54) IMAGE-FORMING APPARATUS INCLUDING DRUM CARTRIDGE HAVING MEMORY STORING FIRST TYPE INFORMATION, AND TONER CARTRIDGE HAVING MEMORY STORING SECOND TYPE INFORMATION

(71) Applicant: BROTHER KOGYO KABUSHIKI KAISHA, Nagoya (JP)

(72) Inventors: Takashi Suzuki, Nagoya (JP); Shingo Fujiwara, Nagoya (JP); Tadao Kyotani, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/466,639

(22) Filed: Sep. 3, 2021

(65) Prior Publication Data

US 2021/0397125 A1 Dec. 23, 2021

Related U.S. Application Data

(63) Continuation of application No. PCT/JP2019/042789, filed on Oct. 31, 2019.

(30) Foreign Application Priority Data

Mar. 28, 2019 (JP) ..... JP2019-063067

(51) Int. Cl.
*G03G 15/00* (2006.01)
*G03G 21/18* (2006.01)
*G03G 15/08* (2006.01)

(52) U.S. Cl.
CPC ..... *G03G 21/1878* (2013.01); *G03G 15/0863* (2013.01); *G03G 15/50* (2013.01); *G03G 21/1889* (2013.01)

(58) Field of Classification Search
CPC ..... G03G 15/0863; G03G 15/50; G03G 21/1875; G03G 21/1878; G03G 21/1889; G03G 2221/1823
See application file for complete search history.

(56) References Cited

U.S. PATENT DOCUMENTS 5,995,774 A 11/1999 Applegate et al.
2006/0204250 A1 9/2006 Ishihara et al.
(Continued)

FOREIGN PATENT DOCUMENTS

JP 2001-109337 A 4/2001
JP 2005-227517 A 8/2005
(Continued)

OTHER PUBLICATIONS

English translation of JP 2009-048470 A (publication date of Mar. 5, 2009), p. 1 of 94 to p. 47 of 94, printed on Apr. 6, 2022.*
(Continued)

*Primary Examiner* — Sophia S Chen
(74) *Attorney, Agent, or Firm* — Merchant & Gould P.C.

(57) ABSTRACT

An image-forming apparatus includes: a toner cartridge configured to accommodate toner; a drum cartridge for use with the toner cartridge; and a controller. The drum cartridge includes a photosensitive drum, and a drum memory storing a first type information indicating a type of the drum cartridge. The controller is configured to communicate with the drum memory. The controller is configured to perform: reading the first type information from the drum memory; and changing an operation of the image-forming apparatus based on the type indicated by the first type information.

12 Claims, 6 Drawing Sheets

(56) References Cited

U.S. PATENT DOCUMENTS

| | | | | |
|---|---|---|---|---|
| 2009/0028582 | A1 | 1/2009 | Okamura et al. | |
| 2012/0051758 | A1* | 3/2012 | Hayakawa ..... | G03G 15/0863 399/12 |
| 2013/0108282 | A1 | 5/2013 | Sonoda et al. | |
| 2014/0186061 | A1 | 7/2014 | Hayakawa et al. | |

FOREIGN PATENT DOCUMENTS

| | | | |
|---|---|---|---|
| JP | 2006-267601 | A | 10/2006 |
| JP | 2008-164892 | A | 7/2008 |
| JP | 2008-257081 | A | 10/2008 |
| JP | 2008-281802 | A | 11/2008 |
| JP | 2009-48470 | A | 3/2009 |
| JP | 2013-97069 | A | 5/2013 |
| JP | 2014-126784 | A | 7/2014 |

OTHER PUBLICATIONS

International Search Report and Written Opinion issued in related international application PCT/JP2019/042789, dated Dec. 3, 2019.
International Preliminary Report on Patentability issued in corresponding International Patent Application No. PCT/JP2019/042789, dated Sep. 28, 2021, 9 pages.
Office Action (Notice of Reasons for Refusal) issued in corresponding Japanese Patent Application No. 2019-063067, dated Oct. 18, 2022.

* cited by examiner

FIG. 2

| FIRST TYPE INFORMATION (DRUM MEMORY) | SECOND TYPE INFORMATION (TONER MEMORY) | ERROR DISPLAY |
|---|---|---|
| STANDARD TYPE | STANDARD TYPE | NOT DISPLAY ERROR |
| | LOW-COST TYPE (SPECIAL TYPE) | DISPLAY ERROR |
| LOW-COST TYPE (SPECIAL TYPE) | STANDARD TYPE | DISPLAY ERROR |
| | LOW-COST TYPE (SPECIAL TYPE) | NOT DISPLAY ERROR |

FIG. 4

| FIRST TYPE INFORMATION (DRUM MEMORY) | SECOND TYPE INFORMATION (TONER MEMORY) | ERROR DISPLAY |
|---|---|---|
| STANDARD TYPE | STANDARD TYPE | NOT DISPLAY ERROR |
| | LOW-COST TYPE (SPECIAL TYPE) | DISPLAY ERROR |
| | BUNDLED TYPE | NOT DISPLAY ERROR |
| LOW-COST TYPE (SPECIAL TYPE) | STANDARD TYPE | DISPLAY ERROR |
| | LOW-COST TYPE (SPECIAL TYPE) | NOT DISPLAY ERROR |
| | BUNDLED TYPE | NOT DISPLAY ERROR |
| BUNDLED TYPE | STANDARD TYPE | NOT DISPLAY ERROR |
| | LOW-COST TYPE (SPECIAL TYPE) | REWRITE FIRST TYPE INFORMATION ONLY FOR A PREDETERMINED NUMBER OF TIMES |
| | BUNDLED TYPE | NOT DISPLAY ERROR |

IMAGE-FORMING APPARATUS INCLUDING DRUM CARTRIDGE HAVING MEMORY STORING FIRST TYPE INFORMATION, AND TONER CARTRIDGE HAVING MEMORY STORING SECOND TYPE INFORMATION

CROSS REFERENCE TO RELATED APPLICATION

This is a by-pass continuation application of International Application No. PCT/JP2019/042789 filed on Oct. 31, 2019 which claims priority from Japanese Patent Application No. 2019-063067 filed Mar. 28, 2019. The entire contents of the earlier applications are incorporated herein by reference.

TECHNICAL FIELD

The present disclosure relates to an image-forming apparatus to which a drum cartridge and a toner cartridge are attachable.

BACKGROUND

There has been known an image-forming apparatus to which a toner cartridge of a standard type and a toner cartridge of a low-cost type are selectively attachable. In such a conventional image-forming apparatus, operation settings need to be changed for every image-forming apparatus such that a low-cost type toner cartridge can be used only in the image-forming apparatus of a contracted customer.

SUMMARY

However, in the above-described conventional image-forming apparatus, changing the operation settings may be cumbersome for the user.

In view of the foregoing, it is an object of the disclosure to provide a configuration that eliminates the need to change operation settings in an image-forming apparatus.

In order to attain the above and other objects, according to one aspect, the disclosure provides an image-forming apparatus including a toner cartridge, a drum cartridge, and a controller. The toner cartridge is configured to accommodate toner. The drum cartridge is for use with the toner cartridge. The drum cartridge includes a photosensitive drum, and a drum memory storing a first type information indicating a type of the drum cartridge. The controller is configured to communicate with the drum memory. The controller is configured to perform: reading the first type information from the drum memory; and changing an operation of the image-forming apparatus based on the type indicated by the first type information.

BRIEF DESCRIPTION OF THE DRAWINGS

The particular features and advantages of the embodiment(s) as well as other objects will become apparent from the following description taken in connection with the accompanying drawings, in which:

FIG. 2 is a table illustrating error display associated with information on types of cartridges attached to the image-forming apparatus according to the first embodiment;

FIG. 4 is a table illustrating error display associated with information on types of cartridges attached to an image-forming apparatus according to a second embodiment of the disclosure;

DETAILED DESCRIPTION

1. First Embodiment

An image-forming apparatus 1 according to a first embodiment of the present disclosure will be described with reference to FIGS. 1 through 3.

Figure 1:
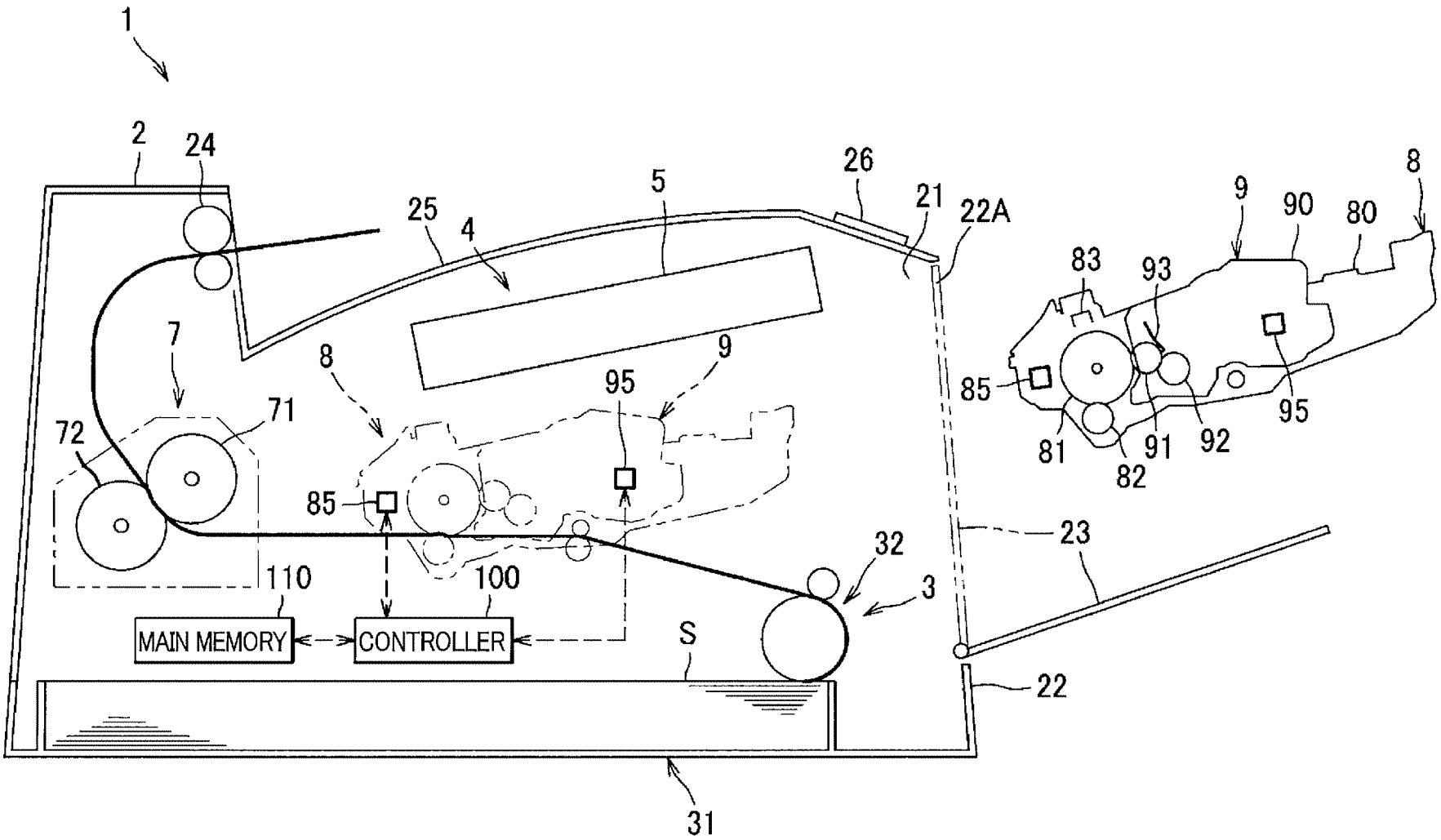
FIG. 1 is a schematic cross-sectional view of an image-forming apparatus according to a first embodiment of the disclosure.

As illustrated in FIG. 1, the image-forming apparatus 1 is a monochromatic laser printer. The image-forming apparatus 1 includes a housing 2, a feeder section 3, an image-forming section 4, a controller 100, a main memory 110, and a display 26.

The housing 2 is a hollow outer casing. The housing 2 includes a pair of side walls 21, and a front wall 22 connecting the side walls 21 together. The front wall 22 has a housing opening 22A. A front cover 23 is provided on the front wall 22 for opening and closing the housing opening 22A.

The feeder section 3 includes a sheet tray 31 and a sheet pick-up mechanism 32. The sheet tray 31 is attachable to and detachable from a lower portion of the housing 2. The sheet pick-up mechanism 32 is configured to supply a sheet S in the sheet tray 31 toward the image-forming section 4.

The image-forming section 4 includes a scanner unit 5, a fixing device 7, a drum cartridge 8, and a toner cartridge 9.

The scanner unit 5 is positioned at an upper internal portion of the housing 2, and includes a laser emitting portion, a polygon mirror, a lens, and a reflection mirror those not illustrated. The scanner unit 5 is configured to irradiate a laser beam at a high scanning speed onto a surface of a photosensitive drum 81 described later.

The controller 100 includes a CPU, a RAM, a ROM, and input/output circuits, for example. The controller 100 is configured to perform arithmetic processing based on information on cartridges attached to the housing 2, programs and data stored in the ROM for controlling printing operations.

The display 26 is positioned on an outer surface of the housing 2. The display 26 is configured to display various messages in response to instructions from the controller 100.

The drum cartridge 8 is positioned between the feeder section 3 and the scanner unit 5. The drum cartridge 8 is attachable to and detachable from the housing 2. Specifically, the drum cartridge 8 is configured to be attached to and detached from the housing 2 through the housing opening 22A which is opened or closed by the front cover 23.

The toner cartridge 9 is attachable to and detachable from the drum cartridge 8. The toner cartridge 9 is attached to the housing 2 in a state where the toner cartridge 9 is attached to the drum cartridge 8.

The drum cartridge 8 includes a frame 80, the photosensitive drum 81, a transfer roller 82. a charger 83, and a drum memory 85. The frame 80 is configured to receive the toner cartridge 9. The photosensitive drum 81 is rotatably supported by the frame 80.

The drum memory 85 is a storage medium storing information, such as an IC chip. However, the drum memory 85 need not be an IC chip. The drum memory 85 stores first type information indicative of a type of the drum cartridge 8.

The toner cartridge 9 includes a casing 90, a developing roller 91, a supply roller 92, a blade 93, and a toner memory 95. The casing 90 is configured to accommodate therein toner. The developing roller 91 is configured to supply the toner to the photosensitive drum 81. The supply roller 92 is configured to supply the toner in the casing 90 to the developing roller 91. The blade 93 is configured to regulate a thickness of a toner layer formed on the developing roller 91.

The toner memory 95 is a storage medium storing information, such as an IC chip. However, the toner memory 95 need not be an IC chip. The toner memory 95 stores second type information indicative of a type of the toner cartridge 9.

In the drum cartridge 8, after the surface of the rotating photosensitive drum 81 is uniformly charged by the charger 83, the surface is exposed to the laser beam emitted from the scanner unit 5 at a high scanning speed. Hence, an electric potential of the exposed region is lowered to form an electrostatic latent image according to image data on the surface of the photosensitive drum 81.

Thereafter, the toner in the toner cartridge 9 is supplied to the electrostatic latent image formed of the photosensitive drum 81 by the developing roller 91 that is rotationally driven to form a toner image on the surface of the photosensitive drum 81. The toner image formed on the surface of the photosensitive drum 81 is then transferred onto a sheet S that is conveyed through a position between the photosensitive drum 81 and the transfer roller 82.

The fixing device 7 includes a heat roller 71 and a pressure roller 72. The pressure roller 72 is positioned to face the heat roller 71. The pressure roller 72 is configured to apply pressure to the heat roller 71. The toner image transferred onto the sheet S is thermally fixed to the sheet S when the sheet S moves past the heat roller 71 and the pressure roller 72.

The sheet S subjected to thermal fixing by the fixing device 7 is then conveyed by a pair of conveyer rollers 24 and is discharged onto a discharge tray 25 by the conveyer roller 24.

The controller 100 is configured to communicate with the drum memory 85. The controller 100 is configured to read the first type information from the drum memory 85. The controller 100 is configured to alter the operation of the image-forming apparatus 1 in accordance with the type indicated by the first type information.

The controller 100 is configured to communicate with the toner memory 95. The controller 100 is configured to read the second type information from the toner memory 95. The controller 100 is configured to change the operation of the image-forming apparatus 1 in accordance with the types indicated by the first type information and the second type information.

Specifically, the controller 100 is configured to determine whether there is an error with respect to the drum cartridge 8 and the toner cartridge 9 in accordance with the types indicated by the first type information and the second type information. In a case where no error is present, an image forming operation will be performed upon input of a print job. On the other hand, in a case where an error is found, an error message is displayed on the display 26 in response to input of a print job. In this way, the controller 100 is configured to change operations in the image-forming apparatus 1. Incidentally, in the case where an error is found, an image forming operation may be or may not be interrupted. In the present embodiment, an image forming operation is configured not to be performed in the image-forming apparatus 1 upon detection of an error.

As illustrated in FIG. 2, the first type information indicates whether the drum cartridge 8 is a standard type or a low-cost type which is an example of a special type. The special type is different from the standard type and represents a special type of the drum cartridge 8. For example, the special type is a low-cost type provided exclusively for a contracted customer at a lower price than the standard type. However, the special type need not be such a low-cost type, but may be other types as long as the special type is different from the standard type.

The second type information indicates whether the toner cartridge 9 is a standard type or a low-cost type which is an example of a special type. The special type is different from the standard type and represents a special type of the toner cartridge 9. For example, the special type is a low-cost type provided exclusively for a contracted customer at a lower price than the standard type. However, the special type need not be such a low-cost type, but may be other types as long as the special type is different from the standard type.

The controller 100 is configured not to display an error message on the display 26 in a case where the controller 100 determines that the first type information is the standard type and that the second type information is the standard type. The controller 100 is configured to display an error message on the display 26 in a case where the controller 100 determines that the first type information is the standard type and that the second type information is the low-cost type (special type). The controller 100 is configured to display an error message on the display 26 in a case where the controller 100 determines that the first type information is the low-cost type (special type) and that the second type information is the standard type. The controller 100 is configured not to display an error message on the display 26 in a case where the controller 100 determines that the first type information is the low-cost type (special type) and that the second type information is the low-cost type (special type).

Next, error determination processing according to the first embodiment configured to be performed by the controller 100 in accordance with the types indicated by the first type information and the second type information will be described with reference to a flowchart illustrated in FIG. 3.

Figure 3:
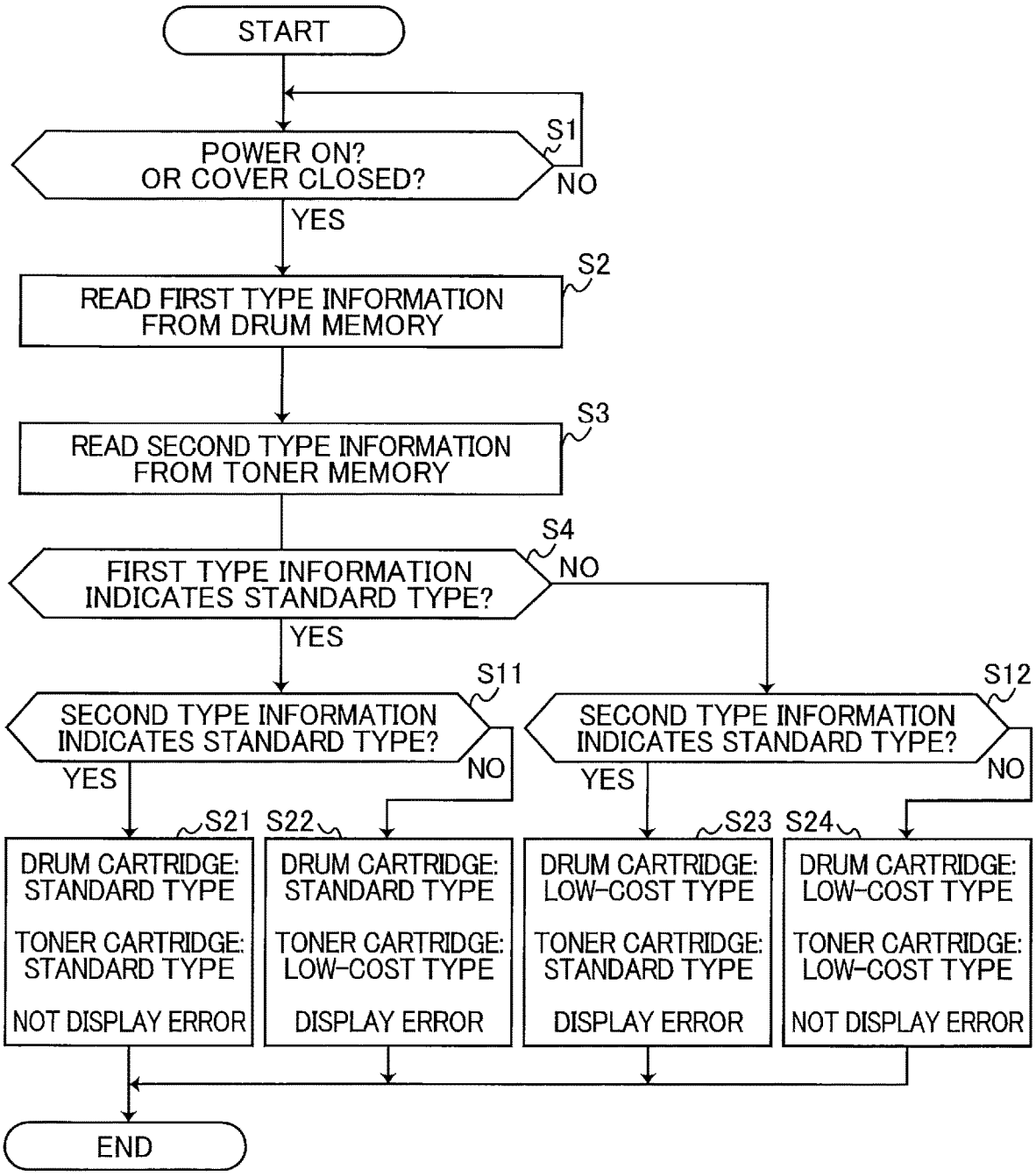
FIG. 3 is a flowchart illustrating control processing performed in the image-forming apparatus according to the first embodiment.

As illustrated in FIG. 3, the controller 100 first detects in S1 whether the image-forming apparatus 1 is powered ON or the front cover 23 is closed. Such power-on of the image-forming apparatus 1 or the closure of the front cover 23 may be sometimes performed in association with replacement of the drum cartridge 8 and the toner cartridge 9. As such, the controller 100 reads the first type information from the drum memory 85 in S2, and reads the second type information from the toner memory 95 in S3 when detecting in S1 that the image-forming apparatus 1 is powered ON or the front cover 23 is closed (S1: YES). The controller 100 waits until the image-forming apparatus 1 is powered ON or the front cover 23 is closed when determining that the image-forming apparatus 1 is not powered or the front cover 23 is still opened (S1: NO).

After the step S3, the controller 100 determines in S4 whether the first type information indicates the standard type.

Specifically, when determining in S4 that the first type information indicates the standard type (S4: YES), the controller 100 then determines in S11 whether the second type information indicates the standard type.

In a case where the controller 100 determines in S11 that the second type information indicates the standard type (S11: YES), the controller 100 does not display an error message on the display 26 in S21, since the drum cartridge 8 is the standard type and the toner cartridge 9 is the standard type.

On the other hand, in a case where the controller 100 determines in S11 that the second type information does not indicate the standard type (S11: NO), the controller 100 permits the display 26 to display an error message in S22, since the drum cartridge 8 is the standard type whereas the toner cartridge 9 is the low-cost type.

In a case where the controller 100 determines in S4 that the first type information does not indicate the standard type (S4: NO), the controller 100 then determines whether the second type information indicates the standard type (S12). In a case where the controller 100 determines in S12 that the second type information indicates the standard type (S12: YES), the controller 100 permits the display 26 to display error message (S23), since the drum cartridge 8 is the low-cost type but the toner cartridge 9 is the standard type.

On the other hand, in a case where the controller 100 determines in S12 that the second type information does not indicate the standard type (S12: NO), the controller 100 does not display an error message on the display 26 (S24), since the drum cartridge 8 is the low-cost type and the toner cartridge 9 is the low-cost type.

The image-forming apparatus 1 according to the first embodiment exhibits advantageous effects described below.

A manufacturer of an image-forming apparatus may provide toner cartridges of a special type. One example of a toner cartridge of the "special type" is a toner cartridge of a low-cost type which is provided solely for a contracted customer at a lower price than the standard type. Conventionally, in order to prevent use of the toner cartridge of the special type (low-cost type) in an image-forming apparatus other than the image-forming apparatus of the contracted customer, operation settings need to be changed in the image-forming apparatus of the contracted customer. However, changing the operation settings in the image-forming apparatus may involve troublesome efforts such as installation of a special software, or visit to the contracted customer by a manufacturer's service person, which may be a burden to both the customer and the manufacturer.

In contrast, in the image-forming apparatus 1 according to the first embodiment, the controller 100 is configured to change operations of the image-forming apparatus 1 in accordance with the first type information stored in the drum memory 85. This configuration can eliminate the need to change operation settings of the image-forming apparatus 1. For example, in a case where the toner cartridge 9 of the low-cost type is supposed to be supplied to a customer under a contract therewith, operation settings of the image-forming apparatus 1 can be changed by using the first type information stored in the drum cartridge 8. That is, use of the prescribed drum cartridge 8 can realize the change in the operations of the image-forming apparatus 1. Further, in a case where the contract between the manufacturer and the customer is to be cancelled, simply stopping use of the prescribed drum cartridge 8 can bring about the change in the operation settings of the image-forming apparatus 1.

Further, the toner cartridge 9 includes the toner memory 95 storing the second type information indicating the type of the toner cartridge 9, and the controller 100 can change the operations of the image-forming apparatus in accordance with the types indicated by the first type information and the second type information. This configuration can also eliminate the need to change the operation settings in the image-forming apparatus 1.

Further, the controller 100 controls the display 26 to display an error message thereon in a case where the drum cartridge 8 is the standard type but the toner cartridge 9 is the special type. This configuration can notify the contracted customer of attachment of improper cartridges.

Further, the controller 100 controls the display 26 to display an error message thereon in a case where the drum cartridge 8 is the special type but the toner cartridge 9 is the standard type. This configuration can notify the customer of attachment of improper cartridges.

2. Second Embodiment

Next, control processing according to a second embodiment configured to be performed by the controller 100 will be described with reference to FIGS. 4 through 6.

Referring to the table of FIG. 4, the second embodiment is different from the first embodiment in that the first type information and the second type information further include a bundled type. The bundled type implies those cartridges boxed and shipped together with the image-forming apparatus 1 for sale.

Specifically, in the second embodiment, the first type information indicates the drum cartridge 8 is the standard type, or the low-cost type, or the bundled type. Likewise, the second type information indicates the toner cartridge 9 is the standard type, or the low-cost type, or the bundled type.

The controller 100 is configured not to display an error message on the display 26 in a case where the controller 100 determines that the first type information indicates the standard type and that the second type information indicates the standard type. The controller 100 is configured to display an error message on the display 26 in a case where the controller 100 determines that the first type information indicates the standard type and that the second type information indicates the low-cost type (special type). The controller 100 is configured not to display an error message on the display 26 in a case where the controller 100 determines that the first type information indicates the standard type and that the second type information indicates the bundled type.

The controller 100 is configured to display an error message on the display 26 in a case where the controller 100 determines that the first type information indicates the low-cost type (special type) and that the second type information indicates the standard type. The controller 100 is configured not to display an error message on the display 26 in a case where the controller 100 determines that the first type information indicates the low-cost type (special type) and that the second type information indicates the low-cost type (special type). The controller 100 is configured not to display an error message on the display 26 in a case where the controller 100 determines that the first type information indicates the low-cost type (special type) and that the second type information indicates the bundled type.

The controller 100 is configured not to display an error message on the display 26 in a case where the controller 100 determines that the first type information indicates the bundled type and that the second type information indicates the standard type. In a case where the controller 100 determines that the first type information indicates the bundled type and that the second type information indicates the low-cost type (special type), the controller 100 is configured to rewrite the first type information to indicate the low-cost type from the bundled type only for a predetermined number of times. The number of times of rewriting is stored in the main memory 110. In the second embodiment, the predetermined number of times is set to "1" ("once"), and "0" is set as an initial value for the number of times of rewriting. The controller 100 is configured not to display an error message on the display 26 in a case where the controller 100 determines that the first type information indicates the bundled type and that the second type information indicates the bundled type.

Next, processing performed by the controller 100 to detect occurrence of an error based on the types indicated by the first type information and the second type information according to the second embodiment will be described with reference to flowcharts illustrated in FIGS. 5 and 6. Incidentally, the processing of steps S1 through S4 (see FIG. 4) are also performed in the second embodiment, and therefore, description therefor will be omitted.

Figure 5:
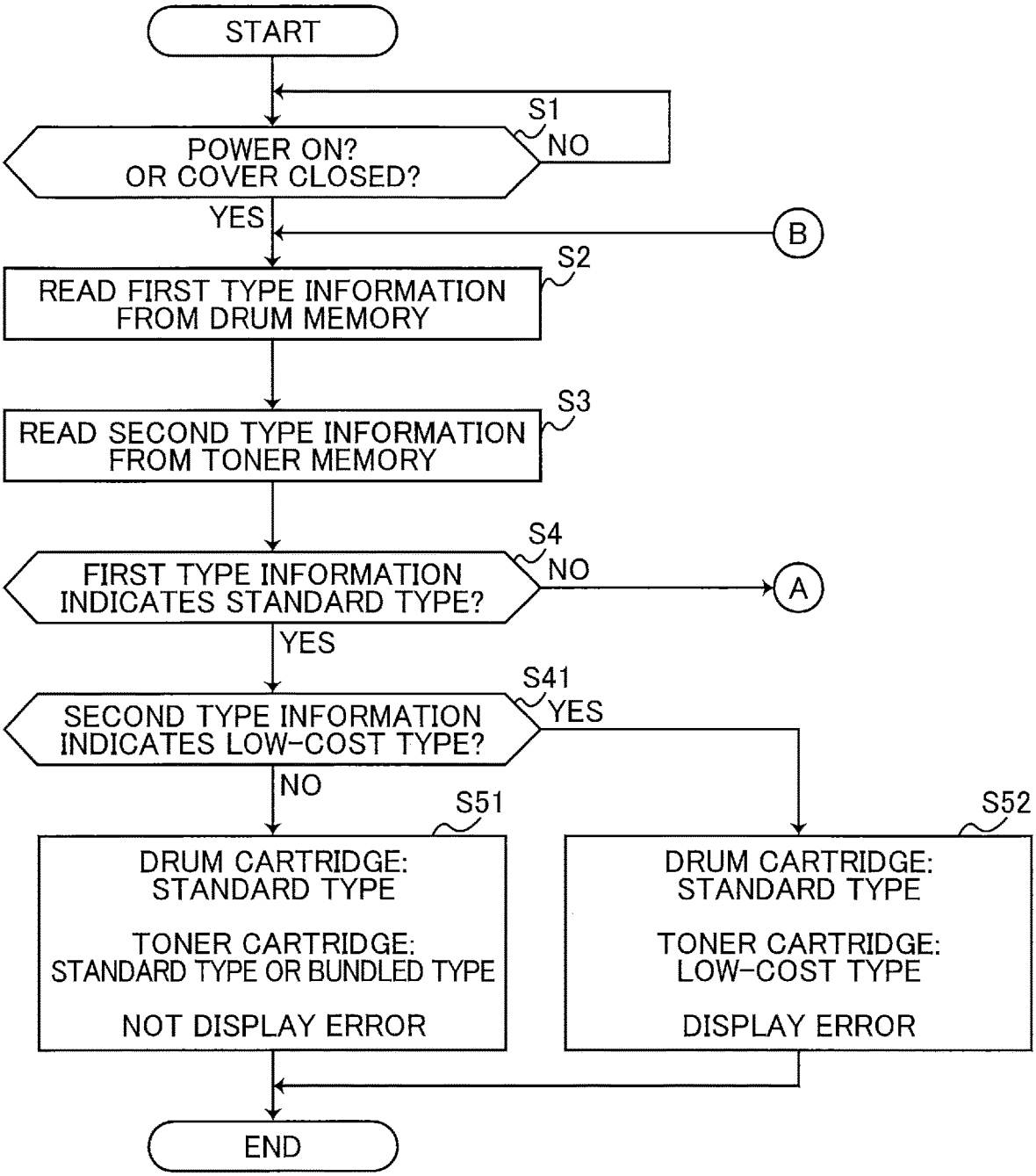
FIG. 5 is a flowchart illustrating a part of a control processing performed in the image-forming apparatus according to the second embodiment.
Figure 6:
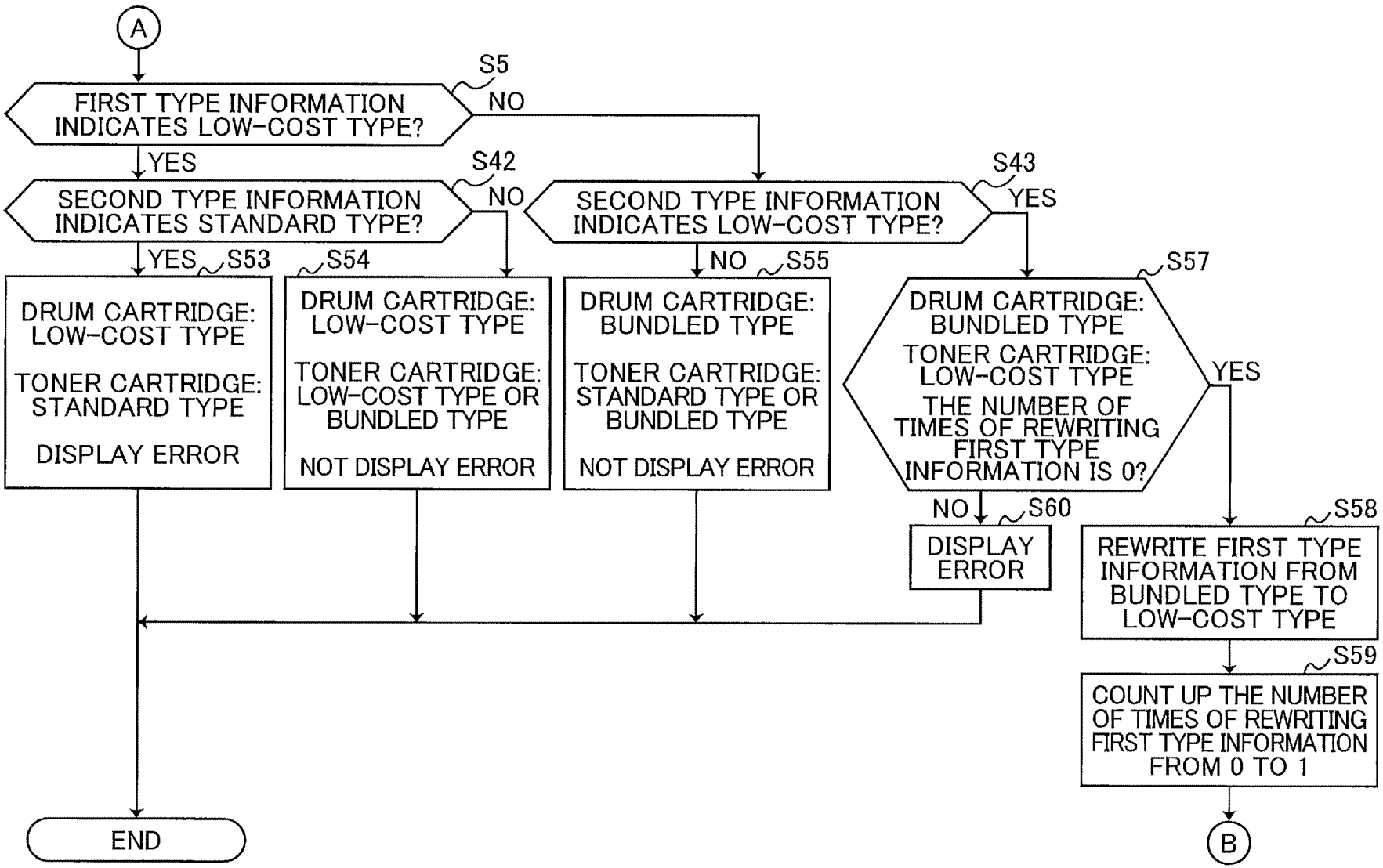
FIG. 6 is a flowchart illustrating a remaining part of the control processing performed in the image-forming apparatus according to the second embodiment.

Referring to FIG. 5, in a case where the controller 100 determines that the first type information indicates the standard type in S4 (S4: YES), the controller 100 determines in S41 whether the second type information indicates the low-cost type.

In a case where the controller 100 determines in S41 that the second type information does not indicate the low-cost type (S41: NO), the controller 100 controls the display 26 not to display an error message in S51, since the drum cartridge 8 is the standard type and the toner cartridge 9 is the standard type or the bundled type.

On the other hand, in a case where the controller 100 determines in S41 that the second type information indicates the low-cost type (S41: YES), the controller 100 controls the display 26 to display an error message in S52, since the drum cartridge 8 is the standard type but the toner cartridge 9 is the low-cost type.

In S4, in a case where the controller 100 determines that the first type information does not indicate the standard type (S4: NO), the controller 100 then determines in S5 (see FIG. 6) whether the first type information indicates the low-cost type. In S5, in a case where the controller 100 determines that the first type information indicates the low-cost type (S5: YES), the controller 100 then determines in S42 whether the second type information indicates the standard type.

In S42, in a case where the controller 100 determines that the second type information indicates the standard type (S42: YES), the controller 100 controls the display 26 to display an error message in S53, since the drum cartridge 8 is the low-cost type and the toner cartridge 9 is the standard type.

On the other hand, in a case where the controller 100 determines in S42 that the second type information does not indicate the standard type (S42: NO), the controller 100 controls the display 26 not to display an error message in S54, since the drum cartridge 8 is the low-cost type and the toner cartridge 9 is either the low-cost type or of the bundled type.

In S5, in a case where the controller 100 determines that the first type information does not indicate the low-cost type (S5: NO), the controller 100 determines in S43 whether the second type information indicates the low-cost type. In a case where the controller 100 determines in S43 that the second type information does not indicate the low-cost type (S43: NO), the controller 100 is configured not to display an error message on the display 26 in S55, since the drum cartridge 8 is the bundled type and the toner cartridge 9 is either the standard type or the bundled type.

On the other hand, in a case where the controller 100 determines in S43 that the second type information indicates the low-cost type (S43: YES), the controller 100 then determines in S57 whether the number of times of rewriting the first type information is 0 ("zero times") since the drum cartridge 8 is the bundled type and the toner cartridge 9 is the low-cost type.

In S57, in a case where the controller 100 determines that the number of times of rewriting the first type information is not 0 or "zero times" (S57: NO), the controller 100 is configured to display an error message on the display 26 in S60.

On the other and, in a case where the controller 100 determines in S57 that the number of times of rewriting the first type information is 0 or "zero times" (S57: YES), the controller 100 rewrites the first type information to indicate the low-cost type instead of the bundled type in S58. After the step of S58, the controller 100 counts up the number of times of rewriting the first type information stored in the main memory 110 from "0" (zero times) to "1" (once) in S59, and returns to the step S2 in FIG. 5. Accordingly, since the controller 100 determines that the drum cartridge 8 is the low-cost type (S4: NO, S5: YES) and that the toner cartridge 9 is the low-cost type or the bundled type (S42: NO), the controller 100 controls the display 26 not to display an error message thereon in S54.

The image-forming apparatus 1 according to the second embodiment exhibits the following advantageous effects.

According to the second embodiment, the first type information is rewritten only by a predetermined number of times to indicate the low-cost type, rather than the bundled type, in a case where the drum cartridge 8 is the bundled type and the toner cartridge 9 is the low-cost type. This means that the drum cartridge 8 of the bundled type can be used along with the toner cartridge 9 of low-cost type. This configuration can ensure that the drum cartridge 8 of the bundled type is readily utilized without being spoiled.

Further, for the drum cartridge 8 of the bundled type, the number of times that the first type information can be rewritten is limited to the predetermined number of times (to be precise, to "1" in present the embodiment). That is, the first type information cannot be rewritten if the number of rewritten times exceeds the predetermined number of times. This configuration can prevent rewriting of the first type information in a case where a drum cartridge 8 which was boxed and shipped together with an image-forming apparatus other than the image-forming apparatus 1 is attached to the image-forming apparatus 1. Rewriting of the first type information from the bundled type to the low-cost type can be prevented in this way. A customer who is unsigned to use the drum cartridge 8 of the low-cost type is thus not allowed to use the toner cartridge 9 of the low-cost type.

3. Variations and Modifications

While the description has been made in detail with reference to the specific embodiment thereof, it would be apparent to those skilled in the art that many modifications and variations may be made thereto without departing from the scope of the disclosure.

For example, in the above-described embodiments, the monochromatic laser printer is employed as an example of the image-forming apparatus of the disclosure. However, a color laser printer, a copying machine, and a multi-function peripheral may also be available as the image-forming apparatus.

Further, in the above-described embodiments, an error message is displayed on the display 26 of the image-forming apparatus 1. However, the error message may be displayed on other places, such as a display of a personal computer connected to the image-forming apparatus 1. Still alternatively, an error may be notified to a user through other means, for example, through voices or sounds.

It would be apparent to those skilled in the art that components appearing in the depicted embodiments and modifications may be suitably selected and combined as long as no conflict is incurred.

REMARKS

The image-forming apparatus 1 is an example of an image-forming apparatus. The toner cartridge 9 is an example of a toner cartridge. The drum cartridge 8 is an example of a toner cartridge. The drum memory 85 is an example of a drum memory of the drum cartridge. The toner memory 95 is an example of a toner memory of the toner cartridge. The controller 100 is an example of a controller. The display 26 is an example of a display of the image-forming apparatus.

What is claimed is:

1. An image-forming apparatus comprising:

a toner cartridge configured to accommodate toner and comprising a toner memory;

a drum cartridge for use with the toner cartridge, the drum cartridge comprising a photosensitive drum, and a drum memory storing a first type information indicating a type of the drum cartridge, the toner memory storing a second type information indicating a type of the toner cartridge; and a controller configured to communicate with the drum memory and the toner memory, the controller being configured to perform:

reading the first type information from the drum memory;

reading the second type information from the toner memory; and changing an operation of the image-forming apparatus based on a combination of the type indicated by the first type information and the type indicated by the second type information.

2. The image-forming apparatus according to claim 1, wherein the first type information indicates the drum cartridge is one of a standard type and a special type.

3. The image-forming apparatus according to claim 2, wherein the first type information indicates the drum cartridge is one of the standard type and a low-cost type as the special type.

4. The image-forming apparatus according to claim 1, further comprising a display, wherein the first type information indicates the drum cartridge is one of a standard type and a special type, wherein the second type information indicates the toner cartridge is one of a standard type and a special type, and wherein the controller is configured to control the display to display an error message thereon in a case where the first type information indicates that the drum cartridge is the standard type and the second type information indicates the toner cartridge is the special type.

5. The image-forming apparatus according to claim 4, wherein the first type information indicates the drum cartridge is one of the standard type and a low-cost type as the special type, and wherein the second type information indicates the toner cartridge is one of the standard type and a low-cost type as the special type.

6. The image-forming apparatus according to claim 4, wherein the first type information further indicates the drum cartridge is one of: the standard type; a low-cost type as the special type; and a bundled type, the drum cartridge of the bundled type being a drum cartridge boxed and shipped with the image-forming apparatus, wherein the second type information indicates the toner cartridge is one of: the standard type; a low-cost type as the special type; and a bundled type, the toner cartridge of the bundled type being a toner cartridge boxed and shipped with the image-forming apparatus, and wherein the controller is configured to rewrite the first type information only by a predetermined number of times to indicate the low-cost type rather than the bundled type in a case where the first type information indicates the drum cartridge is the bundled type and the second type information indicates the toner cartridge is the low-cost type.

7. The image-forming apparatus according to claim 6, wherein the predetermined number of times is once.

8. The image-forming apparatus according to claim 1, further comprising a display, wherein the first type information indicates the drum cartridge is one of a standard type and a special type, wherein the second type information indicates the toner cartridge is one of a standard type and a special type, and wherein the controller is configured to control the display to display an error message thereon in a case where the first type information indicates the drum cartridge is the special type and the second type information indicates the toner cartridge is the standard type.

9. The image-forming apparatus according to claim 8, wherein the first type information indicates the drum cartridge is one of the standard type and a low-cost type as the special type, and wherein the second type information indicates the toner cartridge is one of the standard type and a low-cost type as the special type.

10. The image-forming apparatus according to claim 8, wherein the first type information further indicates the drum cartridge is one of: the standard type; a low-cost type as the special type; and a bundled type, the drum cartridge of the bundled type being a drum cartridge boxed and shipped with the image-forming apparatus, wherein the second type information indicates the toner cartridge is one of: the standard type; a low-cost type as the special type; and a bundled type, the toner cartridge of the bundled type being a toner cartridge boxed and shipped with the image-forming apparatus, and wherein the controller is configured to rewrite the first type information only by a predetermined number of times to indicate the low-cost type rather than the bundled type in a case where the first type information indicates the drum cartridge is the bundled type and the second type information indicates the toner cartridge is the low-cost type.

11. The image-forming apparatus according to claim 10, wherein the predetermined number of times is once.

12. The image-forming apparatus according to claim 1, wherein the toner cartridge is attachable to and detachable from the drum cartridge.

* * * * *